US008665092B2

(12) United States Patent
Dietz et al.

(10) Patent No.: US 8,665,092 B2
(45) Date of Patent: Mar. 4, 2014

(54) MANIPULATION DETECTION SYSTEM FOR CASH BOXES THAT CAN BE INSERTED IN AND REMOVED FROM AUTOMATIC TELLER MACHINES

(75) Inventors: Oliver Dietz, Borchen (DE); Sascha Ringel, Paderborn (DE)

(73) Assignee: Wincor Nixdorf International GmbH (DE)

( * ) Notice: Subject to any disclaimer, the term of this patent is extended or adjusted under 35 U.S.C. 154(b) by 435 days.

(21) Appl. No.: 13/003,098

(22) PCT Filed: Jul. 3, 2009

(86) PCT No.: PCT/EP2009/004815

§ 371 (c)(1),
(2), (4) Date: Jan. 7, 2011

(87) PCT Pub. No.: WO2010/012352

PCT Pub. Date: Feb. 4, 2010

(65) Prior Publication Data

US 2011/0181416 A1 Jul. 28, 2011

(30) Foreign Application Priority Data

Jul. 31, 2008 (DE) ..... 10 2008 035 915

(51) Int. Cl.
*G08B 21/00* (2006.01)

(52) U.S. Cl.
USPC ..... 340/568.7; 340/500; 340/541; 340/568.1; 232/34; 232/37; 53/507

(58) Field of Classification Search
USPC ..... 340/500, 541, 568.1, 568.7; 232/34, 37; 53/507
See application file for complete search history.

(56) References Cited

U.S. PATENT DOCUMENTS

| | | | | |
|---|---|---|---|---|
| 3,626,956 A | | 12/1971 | Sauder | |
| 4,407,312 A | * | 10/1983 | Davila et al. | 453/32 |
| 5,012,075 A | | 4/1991 | Hutchison et al. | |
| 5,615,625 A | | 4/1997 | Cassidy et al. | |
| 7,075,429 B2 | * | 7/2006 | Marshall | 340/540 |
| 7,183,915 B2 | * | 2/2007 | Bartholf et al. | 340/570 |
| 8,127,985 B1 | * | 3/2012 | Kolinski-Schultz | 235/380 |

FOREIGN PATENT DOCUMENTS

| | | |
|---|---|---|
| DE | 690 04 906 T2 | 7/1994 |
| DE | 195 35 787 A1 | 3/1996 |
| EP | 0 418 098 A1 | 3/1991 |

(Continued)

*Primary Examiner* — Mohammad Ghayour
*Assistant Examiner* — Mark Rushing
(74) *Attorney, Agent, or Firm* — Harness, Dickey & Pierce, P.L.C.

(57) ABSTRACT

A manipulation detection system for removable insertable cash cartridges in automated banking machines is described, wherein the cash cartridge has a lockable cash dispensing/deposit opening for disbursing money and/or depositing money in the operating position of the cash cartridge, wherein the cash dispensing/deposit opening is opened automatically when the cash cartridge is inserted into the automated banking machine even before said cassette reaches its operating position, wherein when the cash dispensing/deposit opening is opened, a manipulation alert is generated at the cash cartridge by means of a sensor.

The system is also characterized in that at least two switches (S1, S2, S*) are provided in the cash cartridge, the at least two switches (S1, S2, S*) are actuated automatically when the cash cartridge is inserted into the automated banking machine, the switch actuation sequence of the at least two switches (S1, S2, S*) is evaluated using pre-determined criteria for the generation of a manipulation alert.

17 Claims, 3 Drawing Sheets

(56) References Cited

FOREIGN PATENT DOCUMENTS

| | | | |
|---|---|---|---|
| EP | 0692599 | A1 | 1/1996 |
| EP | 1 530 170 | A1 | 5/2005 |
| EP | 1566513 | A2 | 8/2005 |
| FR | 2858005 | A1 | 1/2005 |
| WO | WO-0129786 | A1 | 4/2001 |

* cited by examiner

MANIPULATION DETECTION SYSTEM FOR CASH BOXES THAT CAN BE INSERTED IN AND REMOVED FROM AUTOMATIC TELLER MACHINES

CROSS-REFERENCE TO RELATED APPLICATIONS

This application is a National Stage of International Application No. PCT/EP2009/004815, filed Jul. 3, 2009. This application claims the benefit and priority of German application 10 2008 035 915.7 filed Jul. 31, 2008. The entire disclosures of the above applications are incorporated herein by reference.

BACKGROUND

This section provides background information related to the present disclosure which is not necessarily prior art.

1. Technical Field

The invention relates to a manipulation detection system for removable insertable cash cartridges in automated banking machines (ABMs). Generic cash cartridges have a lockable cash dispensing/deposit opening for disbursing money and/or depositing money when in the operating position in the automated banking machine.

2. Discussion

Discussion For security reasons, it is important to know whether the cash dispensing/deposit opening of the cash cartridge has been opened without authorization outside the automated banking machine in order to remove bank notes. In this regard, it is of particular interest whether a) the cash cartridge was opened in the time period between being filled with bank notes at a bank or a valuables transport company and its deployment in an automated banking machine, and b) whether the cash cartridge was opened in a time period between its removal from an automated banking machine and the official opening at a bank or a valuables transport company.

For this reason it is proposed in DE 690 04906 T2 that to recognize manipulation via a sensor that detects the opening of the cash dispensing/deposit opening, a manipulation alert is generated at the cash cartridge. A manipulation alert of this type can be used specifically to activate a dye pack located in the cash cartridge. Money in the cash cartridge, particularly bank notes, can thereby be rendered unusable by being dyed with a special ink.

In a system consisting of automated banking machine and cash cartridge, in which, due to the design of the system, the money dispensing/deposit opening is opened automatically, for example by a guide, when inserted into the automated banking machine before reaching the operating position, this opening of the dispensing/deposit opening is problematic to the extent that this permissible opening can erroneously result in a manipulation alert at the cash cartridge. Such a manipulation alert in cash cartridges with a dye pack would lead to undesirable activation of the dye pack which would result in great losses.

SUMMARY OF THE INVENTION

An object of the invention is, therefore, to develop a manipulation detection system that can distinguish in a simple and reliable way between authorized opening of the cash dispensing/deposit opening of a cash cartridge inside the automated banking machine and unauthorized opening outside the automated banking machine.

In accordance with the invention, at least two, preferably three switches are provided in the cash cartridge that are automatically actuated when the cash cartridge is inserted into the automated banking machine. In order to generate a manipulation alert (i.e., some response due to unauthorized tampering) , the switch actuation sequence of the at least two switches is evaluated using predefined criteria. Unauthorized opening of the cash dispensing/deposit opening outside the ABM always leads to a manipulation alert, and in the case of cash cartridges with a dye pack, to activation of said pack because the specified switch actuation sequence does not occur in this instance. The more switches that are used, the more complex the switch actuation sequence and the more reliably manipulation is detected. Through the use of three switches, a very high degree of reliability and security is obtained at an acceptable cost.

In accordance with the invention, an automated banking machine is understood to mean any automat for depositing or dispensing money using cash cartridges. The term automated banking machine includes both self-service and staffed automats, e.g. so-called automatic teller safes. The generic automated banking machine can be operated in a retail operation, for example, in conjunction with a payment station as a point-of-sales terminal.

BRIEF DESCRIPTION OF THE DRAWINGS

The drawings described herein are for illustrative purposes only of selected embodiments and not all possible implementations, and are not intended to limit the scope of the present disclosure.

Using the appended drawings, the invention is to be explained in greater detail in what follows.

Corresponding reference numerals indicate corresponding parts throughout the several views of the drawings.

DETAILED DESCRIPTION OF THE PREFERRED EMBODIMENTS

Figure 1A:
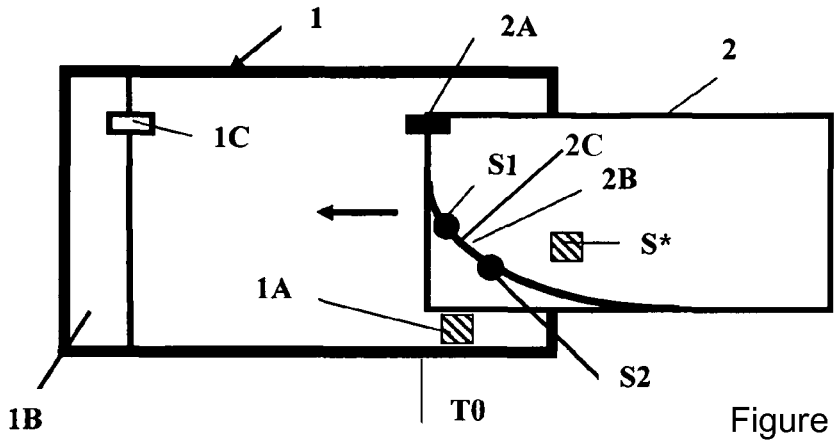
FIGS. 1A-1D show different phases when inserting the cash cartridge into the automated banking machine.

Example embodiments will now be described more fully with reference to the accompanying drawings.

An automated banking machine (1) with a cash cartridge (2) is shown schematically in FIGS. 1A to 1D, where various phases during the insertion of the cash cartridge are shown. The cash dispensing/deposit opening (2C) is located essentially on the front side of the cash cartridge (2). To close this opening (2C), for example, a blind or shutter is provided. The cash dispensing/deposit opening (2C) is opened automatically by a slotted guide (not shown) before it has reached its operating position when the cash cartridge (2) is inserted into the automated banking machine (1). This happens, for instance, by a blind being slid open. The displacement of the blind is shown schematically and identified with the reference numeral 2B. The insertion of the cash cartridge (2) preferably takes place by pushing the cash cartridge (2) into a frame in the automated banking machine (1).

Three switches (S1, S2, S*) are provided in the cash cartridge that are actuated automatically in a specific, pre-determined sequence when the cash cartridge (2) is inserted into the automated banking machine (1). In addition, the cash cartridge has a plug (2A) that, in the fully inserted position (operating position), is connected to a mating connector (1 C)

in the automated banking machine to provide energy and/or data transmission between the automated banking machine and the cash cartridge (2). A magnet (1A) is shown schematically as a component of the automated banking machine, the function of which will be explained later.

As depicted in FIG. 1A, the cash cartridge (2) has already been pushed far enough into the automated banking machine (1) that the cash dispensing/deposit opening (2C) has been opened slightly. At time TO, the switch (S1) in the cash cartridge is actuated. Switch (S1) is preferably a mechanically actuatable switch, e.g. a pushbutton switch that is actuated, for instance, by the displacement of the blind or shutter.

Figure 1B:
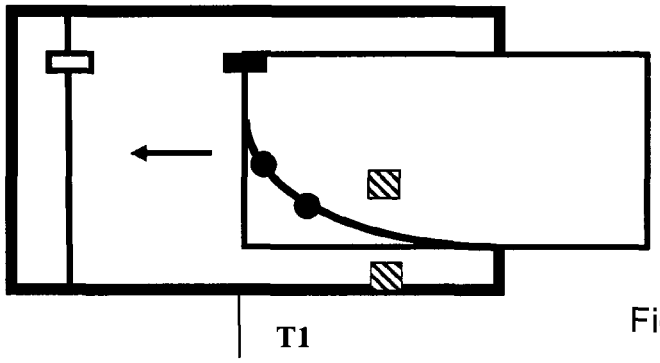

As depicted in FIG. 1B, the cash cartridge (2) has been pushed further into the automated banking machine compared with the position of FIG. 1A. In this position, the switch (S*) in the cash cartridge is actuated at time T1. In the case of switch (S*), it is preferably a Hall switch that is actuated when it detects a magnetic field with a magnetic field strength that lies above a certain threshold. The Hall switch (S*) is thus actuated when the Hall switch (S*) is moved into the effective range of the magnet (1A) as the cash cartridge (2) is inserted. This is the case—as shown in FIG. 1B—at time T1 when the Hall switch (S*) and the magnet (1A) lie directly opposite each other and the distance between Hall switch (S*) and magnet (1A) is minimal.

Figure 1C:
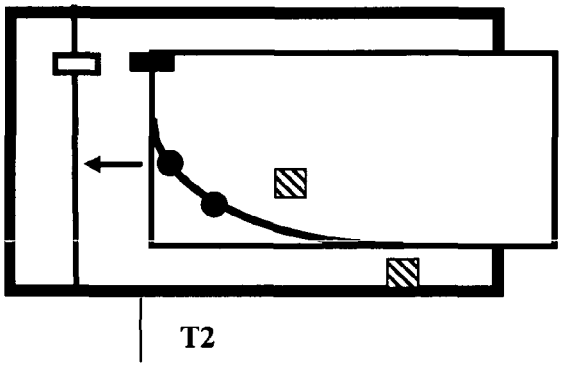

As shown in FIG. 1C, the cash cartridge (2) has been pushed further into the automated banking machine compared with the position of FIG. 1B. In this position, the cash dispensing/deposit opening (2C) is already almost completely open. The Hall switch (S*) is no longer within the effective range of the magnet (1A) in this position. The switch (S2) is actuated in this position at time T2. As in the case of switch (S1), switch (S2) is preferably a mechanically actuatable switch, e.g. a pushbutton switch that is actuated for example by the displacement of the blind or shutter.

Figure 1D:
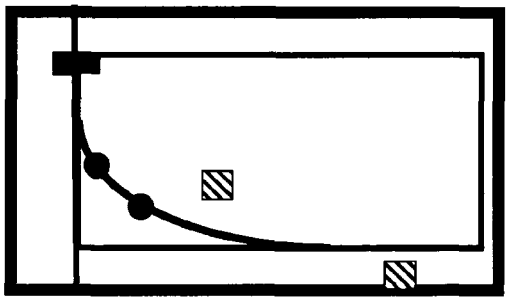

As shown in FIG. 1D, the cash cartridge (2) is located in the completely inserted position, i.e. in the operating position. In this position, the cash dispensing/deposit opening (2C) is fully open. Additionally, the plug (2A) for the cash cartridge and the mating connector (1C) of the automated banking machine (1) are in electrical contact with each other. In the operating position, money can be removed from and/or deposited into the cartridge (2) by way of a module (1B) located in the automated banking machine (1).

The switch times T0, T1 and T2 are indicated symbolically in FIGS. 1A-1C at the locations where the front face of the cash cartridge (2) has reached the respective positions at which switches S1, S* or S2 are actuated.

Figure 2:
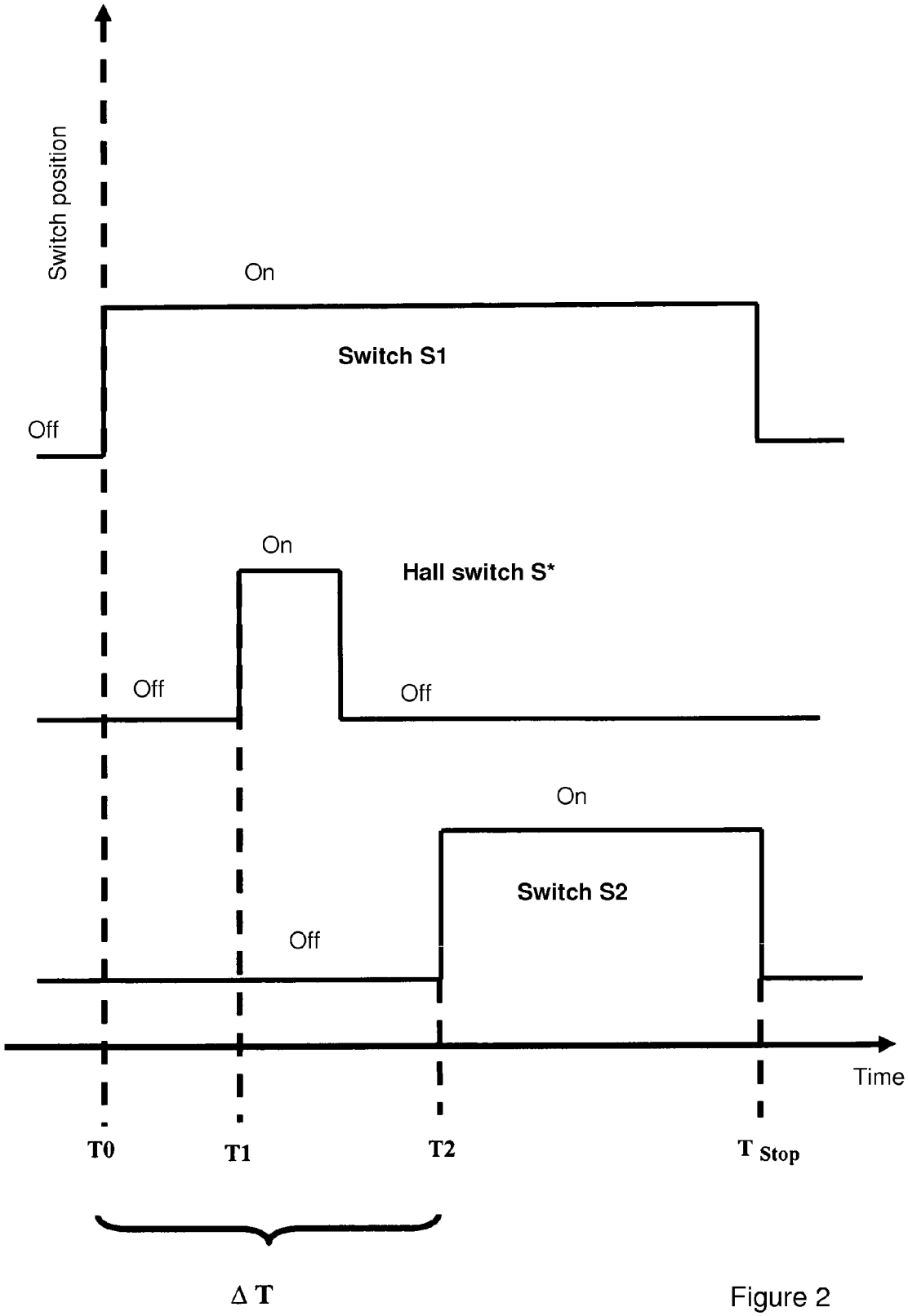
FIG. 2 shows timing diagrams for the switch actuations.

The sequence of switch actuations (S1→S*→S2), as was explained using FIGS. 1A-1D, is shown again in the timing diagram in FIG. 2. Also shown there is the switch position (also known as switch status) for each of the switches (S1, S2, S*) relative to the time when the cash cartridge (2) was inserted. Switch (S1) is the first to be actuated, where the actuation of this switch (S1) defines time T0. At time T1, the Hall switch (S*) is actuated. As soon as the Hall switch (S*) has left the effective range of the magnet (1A) as the cash cartridge (2) is inserted further, the switch status of the Hall switch (S*) returns from "On" to "Off". At time T2, switch (S2) is actuated as the last of the three switches.

In one embodiment of the invention provision is made for switches S1 and S2 to remain in the "On" status after actuation until the cash cartridge (2) is in the operating position at time $T_{stop}$, which is detected through the plug contact (cash cartridge plug/mating connection of automated banking machine).

In an alternative embodiment, provision is made for switches S1 and S2 to remain in the "On" status after actuation until the cash dispensing/deposit opening (2C) is closed again after being removed from the automated banking machine (1).

In further alternative embodiment, provision is made for switches S1 and S2 to return automatically again from status "On" to status "Off" after a certain time following actuation.

A manipulation alert is always generated when the switch actuation sequence detected does not match the previously defined switch actuation sequence for the system. The predefined switch actuation sequence is determined as follows:

First, actuation of switch S1 (Off→On), then actuation of switch S* (Off→On) and then actuation of switch S2 (Off→On).

In a further developed variant, the pre-defined resetting of switch (S*) in the switch actuation sequence is scanned:

First, actuation of switch S1 (Off→On), then actuation of switch S* (Off→On), then the resetting of switch S* (On→Off), and then actuation of switch S2 (Off→On).

The more complex the pre-defined switch actuation sequence is, the more difficult it is to imitate said sequence outside the automated banking machine.

Furthermore, provision is also made not only to scan the sequence of switch actuation per se but also whether said sequence took place within a pre-determined time period (ΔT). For this reason, a mechanical resistance to insertion (not shown) is provided that has to be overcome in terms of time when inserting the cash cartridge (2) before the first switch (S1) is actuated. To overcome this resistance, the operator has to exert a certain minimum force when inserting the cash cartridge which ensures that after overcoming this resistance, a maximum time is not exceeded to complete the subsequent distance over which the three switches (S1, S*, S2) are then actuated. In other words, overcoming the resistance to insertion effects sufficient impetus so that the time period between actuation of the first switch (S1) and the last switch (S2) can be reduced to a calculable maximum amount.

Provision is further made in one embodiment to scan the time intervals between actuation of the individual switches.

The pre-defined criteria, using which the switch actuation sequence detected is evaluated, are accordingly: fixed sequence for switch actuation and/or reset, time period for the actuation of all switches and/or time intervals between individual switch actuations.

Through the use of at least one non-mechanically actuatable switch S* (e.g. in the form of a Hall switch), which requires a further element (e.g. magnet) located on the automated banking machine (1) for its actuation, the reliability of the manipulation detection system is substantially increased because a fraudulent re-creation of the switch activation sequence presupposes precise knowledge of the magnet, its strength, installation location and distance to the Hall sensor at the time of actuation.

In the manipulation detection system in accordance with the invention, generation of a manipulation alert is used specifically to activate a dye pack located in the cash cartridge (2) in order make the money in the cash cartridge (2) unusable by dying said money with ink in the event of manipulation (=unauthorized opening of the cash dispensing/deposit opening outside the automated banking machine). Alternatively or additionally, the manipulation alert can also be used to generate an optical and/or acoustic manipulation alert signal at the cash cartridge (2). The manipulation alert can also be saved in a manipulation memory (not shown) of the cash cartridge (2).

In one embodiment of the invention, provision is made to use the actuation of one of the three switches (S1, S2, S*) to generate a provisional manipulation alert, where this provisional manipulation alert is canceled if the evaluation of the switch actuation sequence shows that no manipulation has taken place. Only if the evaluation of the switch actuation sequence shows that manipulation has taken place, does the preliminary manipulation alert became a final manipulation alert, which then results in activation of a dye pack for example. The use of switch (S2) is particularly suitable for generating a preliminary manipulation alert because the switch (S2) is actuated when the cash dispensing/deposit opening (2C) is already almost fully open.

The manipulation detection system in accordance with the invention, which is specifically also intended to prevent the generation of an unwanted manipulation alert during insertion into an automated banking machine (1), has the advantage that it also operates if the power supply to the automated banking machine (1) fails when the cash cartridge (2) is inserted since the switches (S1, S2, S*) and the evaluation for the detection of manipulation are located in the cash cartridge (2) that uses an independent power supply, e.g. through a battery. In this way, erroneous triggering of the dye pack when the cash cartridge (2) is inserted can be reliably prevented if the power supply for the automated banking machine fails.

Figure 3:
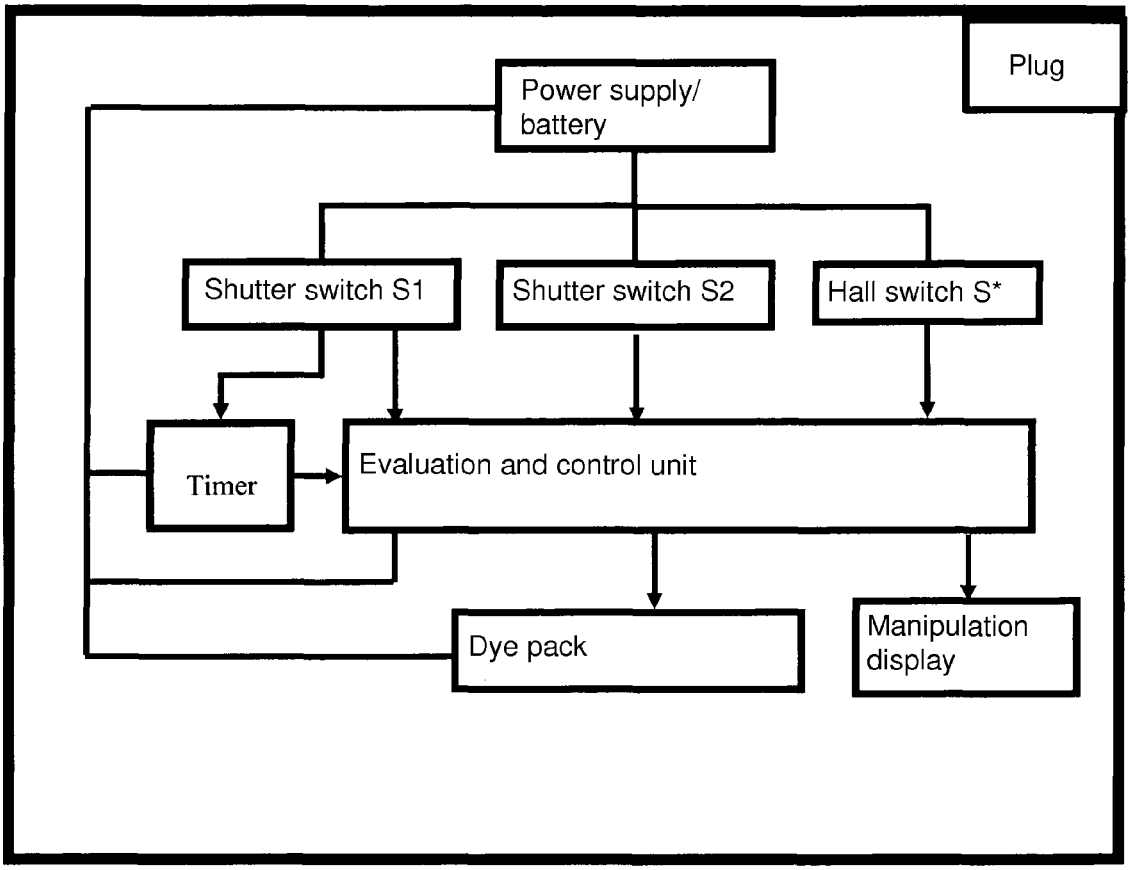
FIG. 3 shows a block diagram of a cash cartridge with the components located therein.

FIG. 3 shows a block diagram for a cash cartridge with the components located therein. The battery supplies the remaining components with energy (current, voltage). In the operating position, the components can also be supplied with energy through the plug from the automated banking machine. The switch modes of the three switches are scanned and evaluated by an evaluation and control unit in order to check whether the switch actuation sequence scanned matches the pre-defined criteria. The timer is started with the actuation of the first switch (S1), which defines time T0. Actuation of the last switch (S2) at time T2 defines the end of the switch actuation sequence, where $\Delta T = T2 - T1$.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. A detection system for removable insertable cash cartridges in automated banking machines, wherein the cash cartridge has a lockable cash dispensing/deposit opening for disbursing money or depositing money when the cash cartridge is in an operating position in the automated banking machine, wherein the cash dispensing/deposit opening is opened automatically before the cartridge reaches the operating position and as the cash cartridge is being inserted into the automated banking machine, wherein a manipulation alert is generated at the cash cartridge when the cash dispensing/deposit opening is opened, comprising wherein:

at least two switches are provided in the cash cartridge, each one of the at least two switches are configured to be actuated as the opening is opened, each one of the at least two switches are actuated automatically as the cash cartridge is being inserted into the automated banking machine and as the opening is being opened, the switch actuation sequence of the at least two switches is evaluated using pre-defined criteria for the generation of a manipulation alert, and the actuation of one of the switches is used to generate a preliminary manipulation alert, where this preliminary manipulation alert is canceled if the result of the evaluation of the switch actuation sequence shows that no manipulation has taken place.

2. The detection system from claim 1, wherein a manipulation alert is generated when the switch actuation sequence detected does not match a pre-determined switch actuation sequence.

3. The detection system from claim 2, wherein a manipulation alert is generated when the actuation of the at least two switches does not take place within a pre-determined time period.

4. The detection system from claim 1, wherein the cash cartridge has a dye pack to render the money in the cash cartridge unusable by dying, where the dye pack is activated when a manipulation alert is generated.

5. The detection system from claim 1, wherein at least one of the two switches is a mechanically actuatable switch.

6. The detection system from claim 1, wherein at least one of the two switches is a non-mechanically actuatable switch.

7. The detection system from claim 6, wherein the non-mechanically actuatable switch is a Hall switch that is actuated by a magnet located in the automated banking machine when the cash cartridge with the Hall switch is moved past the magnet as the cash cartridge is inserted into the automated banking machine.

8. The detection system from claim 1, wherein a resistance to insertion must be overcome in terms of time before the actuation of a first switch as the cash cartridge is inserted into the automated banking machine.

9. A detection system for detecting authorized opening of a cash cartridge when inserted within an automated banking machine (ABM) comprising:

a lockable cash dispensing/deposit opening of the cash cartridge for disbursing money or depositing money therethrough, the opening is configured to open as the cash cartridge is being inserted into the ABM through cooperation between the cash cartridge and the ABM; and a plurality of switches included with the cash cartridge, each one of the plurality of switches are configured to be actuated according to a predefined actuation sequence through cooperation with the ABM as the cash cartridge is being inserted within the ABM and as the door is being opened;

wherein actuation of the switches within a predetermined period of time according to the predefined actuation sequence as the cash cartridge is inserted into the ABM disables a manipulation alert configured to activate when the opening is opened; and wherein the manipulation alert activates if the opening is opened without the switches being actuated according to the predefined actuation sequence within the predetermined period of time; and wherein actuation of one of the plurality of switches is used to generate a preliminary manipulation alert, the preliminary manipulation alert is canceled if the result of the evaluation of the switch actuation sequence shows that no manipulation has taken place.

10. The detection system of claim 9, wherein the cash cartridge includes a dye pack that is activated when the manipulation alert is generated.

11. The detection system of claim 9, wherein the plurality of switches are actuated by cooperation with a surface of the ABM as the cash cartridge is inserted within the ABM.

12. The detection system of claim 9, wherein at least one of the plurality of switches are mechanically actuatable.

13. The detection system of claim 9, wherein at least one of the plurality of switches is a non-mechanically actuatable switch.

14. The detection system of claim 13, wherein the non-mechanically actuatable switch is a Hall switch that is actuated by a magnet of the automated banking machine when the cash cartridge with the Hall switch is moved past the magnet as the cash cartridge is inserted into the automated banking machine.

15. The detection system of claim 9, wherein a resistance to insertion must be overcome in terms of time before the actuation of a first switch as the cash cartridge is inserted into the automated banking machine.

16. A method for detecting authorized opening of a cash cartridge when inserted within an automated banking machine (ABM) comprising:

inserting the cash cartridge within the ABM such that cooperation with the ABM opens a lockable cash dispensing/deposit opening of the cash cartridge for disbursing money or depositing money therethrough; and inserting the cash cartridge within the ABM such that cooperation with the ABM actuates each one of a plurality of switches included with the cash cartridge according to a predefined actuation sequence as the cash cartridge is inserted within the ABM and as the opening is being opened by cooperation with the ABM;

wherein actuation of the switches according to the predefined actuation sequence as the cash cartridge is inserted into the ABM disables a manipulation alert configured to activate when the opening is opened; and wherein the manipulation alert activates if the opening is opened without the switches being actuated according to the predefined actuation sequence within a predetermined period of time; and wherein a preliminary manipulation alert is activated when one of the plurality of switches is actuated, the preliminary manipulation alert is canceled if evaluation of the switch actuation sequence shows that no manipulation has taken place.

17. The method of claim 16, wherein each one of the plurality of switches is actuated as the opening is opened during insertion of the cash cartridge into the ABM.

* * * * *